United States Patent [19]

Parker

[11] 4,184,046

[45] Jan. 15, 1980

[54] COMPATIBLE SINGLE SIDEBAND SYSTEM FOR AM STEREO

[75] Inventor: Norman W. Parker, Wheaton, Ill.

[73] Assignee: Motorola, Inc., Schaumburg, Ill.

[21] Appl. No.: 894,051

[22] Filed: Apr. 6, 1978

[51] Int. Cl.[2] ..... H04H 5/00

[52] U.S. Cl. ..... 179/1 GS; 325/61

[58] Field of Search ..... 179/1 GS; 325/36, 47, 325/61

[56] References Cited

U.S. PATENT DOCUMENTS

| | | | |
|---|---|---|---|
| 2,403,385 | 7/1946 | Loughlin | 179/1 GS |
| 3,068,475 | 12/1962 | Avins | 325/36 |
| 3,148,342 | 9/1964 | Holt | 179/1 GS |
| 3,218,393 | 11/1965 | Kahn | 325/36 |
| 3,908,090 | 9/1975 | Kahn | 179/1 GS |

*Primary Examiner*—Douglas W. Olms

*Attorney, Agent, or Firm*—Margaret Marsh Parker; James W. Gillman

[57] ABSTRACT

A CSSB system for AM stereo provides both second and third order sideband correction in the transmitted signal for reduction of distortion at the receivers. Sum and difference signals are derived from two audio program signals (L and R) and shifted in phase 90° with respect to each other. The carriers is then phase modulated with the ratio of these two signals and amplitude modulated with the sum signal.

8 Claims, 6 Drawing Figures

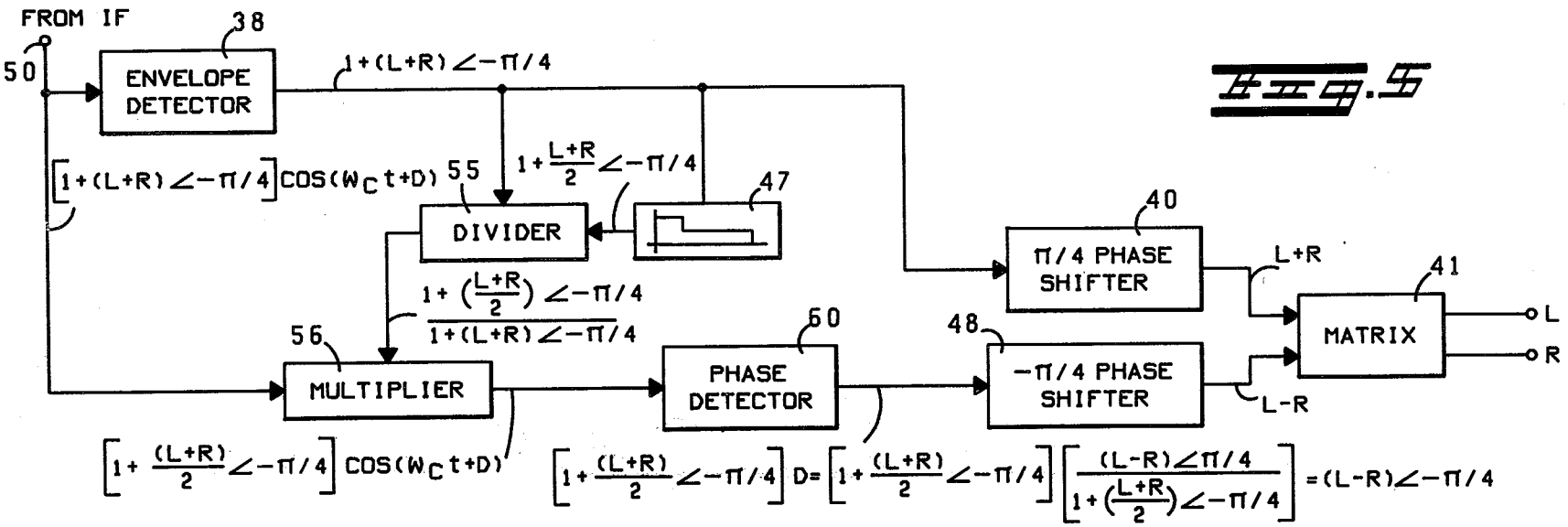
FIG. 5
FROM IF
50
ENVELOPE DETECTOR
38
$1+(L+R)\angle-\pi/4$
$[1+(L+R)\angle-\pi/4]\cos(\omega_C t+D)$
DIVIDER
55
$1+\frac{L+R}{2}\angle-\pi/4$
47
$1+\left(\frac{L+R}{2}\right)\angle-\pi/4$
$1+(L+R)\angle-\pi/4$
MULTIPLIER
56
$\left[1+\frac{(L+R)}{2}\angle-\pi/4\right]\cos(\omega_C t+D)$
PHASE DETECTOR
50
$\left[1+\frac{(L+R)}{2}\angle-\pi/4\right]$
$D=\left[1+\frac{(L+R)}{2}\angle-\pi/4\right]$
$\pi/4$ PHASE SHIFTER
40
$-\pi/4$ PHASE SHIFTER
48
L+R
L-R
MATRIX
41
L
R
$\left[\frac{(L-R)\angle\pi/4}{1+\left(\frac{L+R}{2}\right)\angle-\pi/4}\right]=(L-R)\angle-\pi/4$

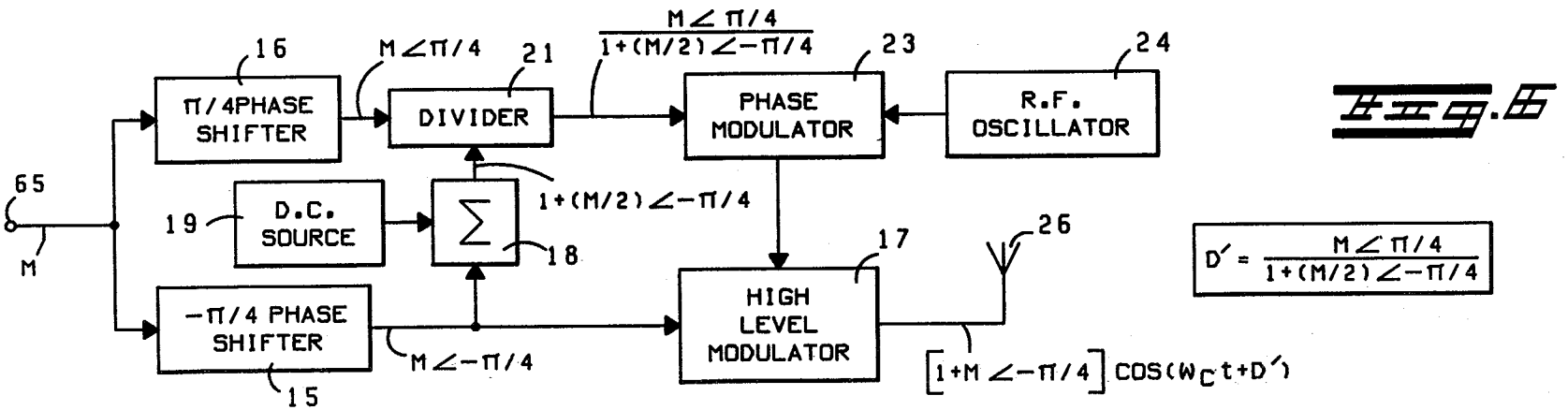
FIG. 6
65
M
$\pi/4$PHASE SHIFTER
16
D.C. SOURCE
19
$-\pi/4$ PHASE SHIFTER
15
$M\angle-\pi/4$
$M\angle\pi/4$
DIVIDER
21
$1+(M/2)\angle-\pi/4$
18
$\frac{M\angle\pi/4}{1+(M/2)\angle-\pi/4}$
PHASE MODULATOR
23
R.F. OSCILLATOR
24
HIGH LEVEL MODULATOR
17
$[1+M\angle-\pi/4]\cos(\omega_C t+D')$
26
$D'=\frac{M\angle\pi/4}{1+(M/2)\angle-\pi/4}$

COMPATIBLE SINGLE SIDEBAND SYSTEM FOR AM STEREO

BACKGROUND OF THE INVENTION

The present invention relates to the field of compatible AM stereophonic systems of transmitting and receiving, and more particularly, to a system wherein one program signal may be derived from the upper sideband signals of the received transmission and the other program signal from the lower sideband signals.

A system known in the art (U.S. Pat. No. 3,908,090) for providing a similar transmitted signal also derives sum and difference signals from two program signal sources (L and L) and shifts them to provide a 90° phase difference with respect to each other. The goal of this system is to transmit information derived from one program signal on one set of sidebands and the second program signal information on the other set of sidebands. However, this system utilizes a two-term series (first and second order sidebands) and operates on only the second order term to provide the desired output spectrum. The carrier is amplitude modulated with the sum signal (1+L+R). The two program signals (unshifted in phase) are individually coupled to frequency doublers and the double frequency signals are combined substractively to provide a second difference signal of the form $[L(2\omega)-R(2\omega)]$. This latter signal is amplified in a variable gain amplifier. The first difference signal (L−R) is coupled to a rectifier, and the variable gain amplifier is gain-controlled by the rectifier output signal. The rectifier/amplifier combination is termed a "level squarer." Thus the second order sideband level is controlled by the level of the first order sideband, but the higher order sidebands are unaffected. The variable gain amplifier output signal is added to the first difference signal and a carrier frequency signal is phase modulated by the combined signal. Since the modulator produces relatively small amounts of phase modulation, the phase modulated signal is frequency multiplied, then shifted in frequency to the carrier frequency of the transmitter. With this form of transmitted signal, it is possible to produce stereophonic reception of a sort by tuning one monophonic receiver to a frequency approximately one-fourth channel width lower than the carrier frequency and a second receiver to a frequency correspondingly higher than the carrier frequency.

This system of transmitting stereophonic information substantially shifts first and second order sidebands, but does nothing for the higher order sidebands which can produce perceptible distortion components in the received stereophonic signal. When it is desired to provide an AM stereo signal with left information on one set of sidebands and right information on the other set, it is important to provide undistorted information on each sideband.

SUMMARY OF THE INVENTION

It is therefore, an object of the present invention to provide and decode an AM stereophonic signal which has undistorted left program information on one set of sidebands and undistorted right program information on the other set.

It is a particular object to provide this signal by transmitting the exact sidebands required for reception of the left and right program signals.

These objects and others are provided in a system wherein sum and difference signals are produced from the left (L) and right (R) program information signals. The sum and difference signals are phase shifted to be 90° out of phase with respect to each other. It is generally preferred to shift one signal by $+\pi/4(+45°)$ and the other by $-\pi/4(-45°)$. A DC component is added to the sum signal and the difference signal is divided by that total signal. A carrier frequency signal is phase modulated by the divider output signal, then amplitude modulated with the 1+L+R signal to provide a transmitted signal of the form $(1+L+R)\cos(\omega_c t+R)$ where R is a signal proportional to $[(L-R)\angle\pi/4]/[1+(L+R)\angle-\pi/4]$.

The stereo signal may be decoded in various ways, providing either exact demodulation of the original modulation signals or, in a simpler circuit, output signals which approximate the original modulation signals.

BRIEF DESCRIPTION OF THE DRAWING

FIG. 5 is a block diagram of still another embodiment of the receiver for the same system.

FIG. 6 is a block diagram of another embodiment of the transmitter.

DETAILED DESCRIPTION OF A PREFERRED EMBODIMENT

Figure 1:
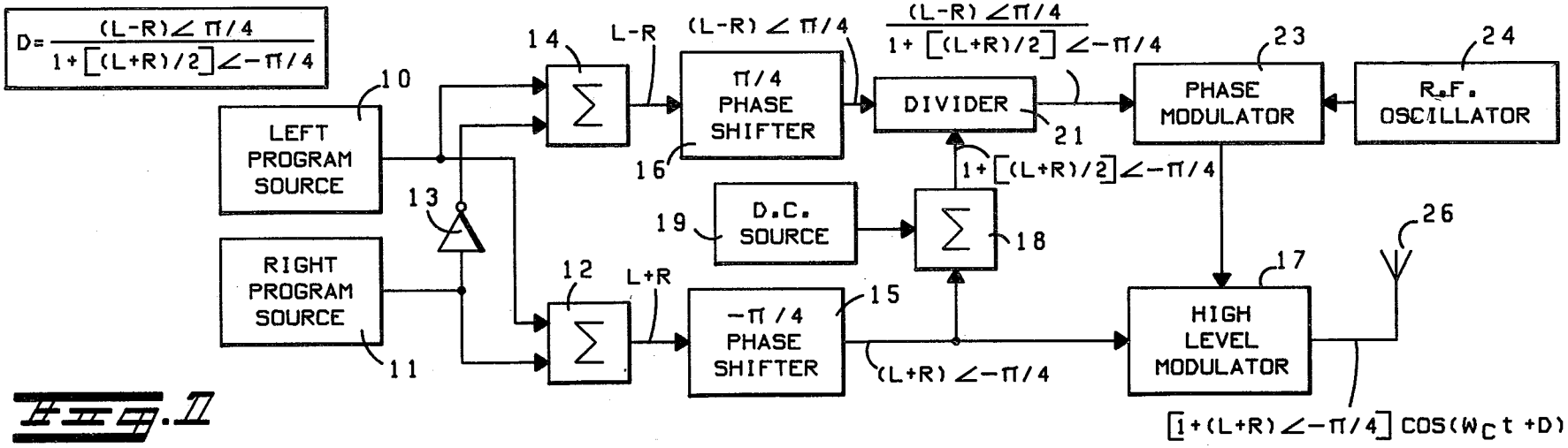
FIG. 1 is a block diagram of a transmitter for providing the signal to be transmitted in accordance with the present invention.

The system of the invention may be best understood with reference to the accompanying drawing in which like parts have like reference numerals throughout.

The transmitter of FIG. 1 is a transmitter for sending two sets of information which can then be separated at a receiver. These input signals will be discussed in terms of a stereophonic signal having "left" and "right" signals, which should be considered exemplary only. The receiver of FIG. 1 includes a left program source 10 and a right program source 11, both of which are coupled to an adder 12 for providing an L+R output signal. The two program sources could, of course, be two microphones or groups of microphones, stereophonic recordings of any type, etc. The right signal is also inverted in an inverter 13 and combined subtractively with the left signal in an adder 14 to provide an L−R output signal. The output signal from the adder 12 is coupled to a phase shifter 16 for shifting the phase thereof by $-\pi/4$ radians. The output signal L−R from the adder 14 is coupled to a phase shifter 16 for shifting the phase thereof by $\pi/4$ radians. The output signal from the phase shifter 15 which is $(L+R)\angle-\pi/4$ is coupled to a high level modulator 17 and to an adder 18. A DC source 19 is also coupled to the adder 18 for adding a constant voltage to the sum signal. The combined output signal of the adder 18 is then $1+(L+R)/2\angle-\pi/4$ which is coupled to a divider 21 as is the output of the phase shifter 16. The output signal from the divider 21 is therefore $[(L-R)\angle\pi/4]/[1+(L+R)/2\angle-\pi/4]$. This output signal is coupled to a phase modulator 23 as is the output of an RF oscillator 24. The RF oscillator 24 would typically be a crystal controlled, carrier frequency oscillator. The carrier frequency signal, phase modulated by the output of the divider 21, is coupled to the high level modulator 17 where it is amplitude modulated by the output of the phase shifter 15 and coupled therefrom to an antenna 26, a standard AM transmission antenna.

Figure 2:
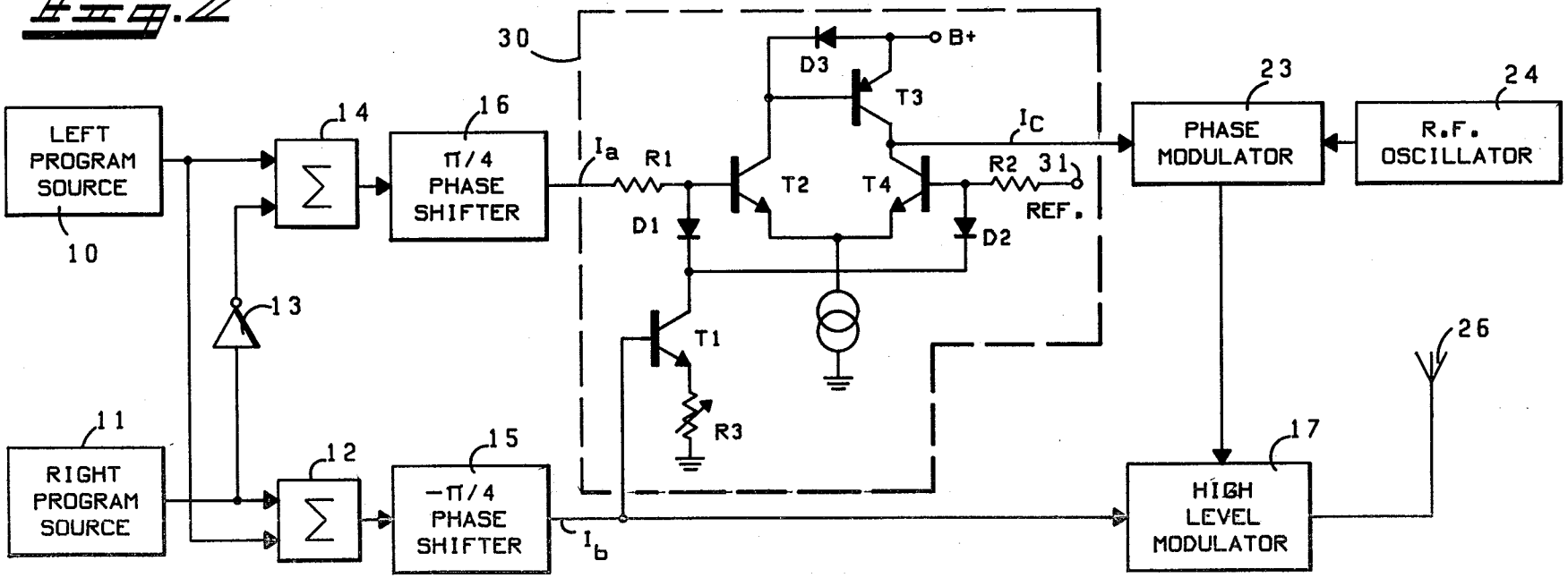
FIG. 2 is another block diagram of the transmitter of FIG. 1 with certain portions in schematic form.

FIG. 2 is a block diagram similar in many respects to the block diagram of FIG. 1, but showing a possible embodiment, in dashed line 30, which performs the functions of the DC source 19, the adder 18 and the divider 21 of FIG. 1. In the circuit marked 30, transistors T2 and T4 form a differential amplifier. The diode D3 and transistor T3 are a current mirror. The reference terminal 31 supplies a DC voltage. Through resistors R1, R2 and R3, diodes D1 and D2, and transistor T1, a DC voltage level is established which is the "one" on the output signal of the circuit 30. This voltage must be at least twice the audio peak voltage for satisfactory operation of the circuit. In terms of current signals, letting $I_a$ equal the signal from the phase shifter 16, and $I_b$, the current from the phase shifter 15, the output current $I_c$ equals $KI_a/I_b$ where K is a function of the current source 33. $I_a$ which flows through R1, R2, D1 and D2 may be represented as $E_a/2R$ where 2R equals the sum of the values of R2 and R3 which are larger value resistors. $I_b$ equals $I_{max} \cos \phi$ where $I_{max}$ is the peak signal current from the phase shifter 16.

It may be noted at this point that if identical signals were provided to both of the phase shifters 16 and 17, instead of differing signals the signal at the output of the transmitter of FIGS. 1 and 2 would be what is termed a compatible single sideband signal (CSSB); that is, all sidebands would be on one side of the carrier frequency. (See FIG. 6).

Figure 3:
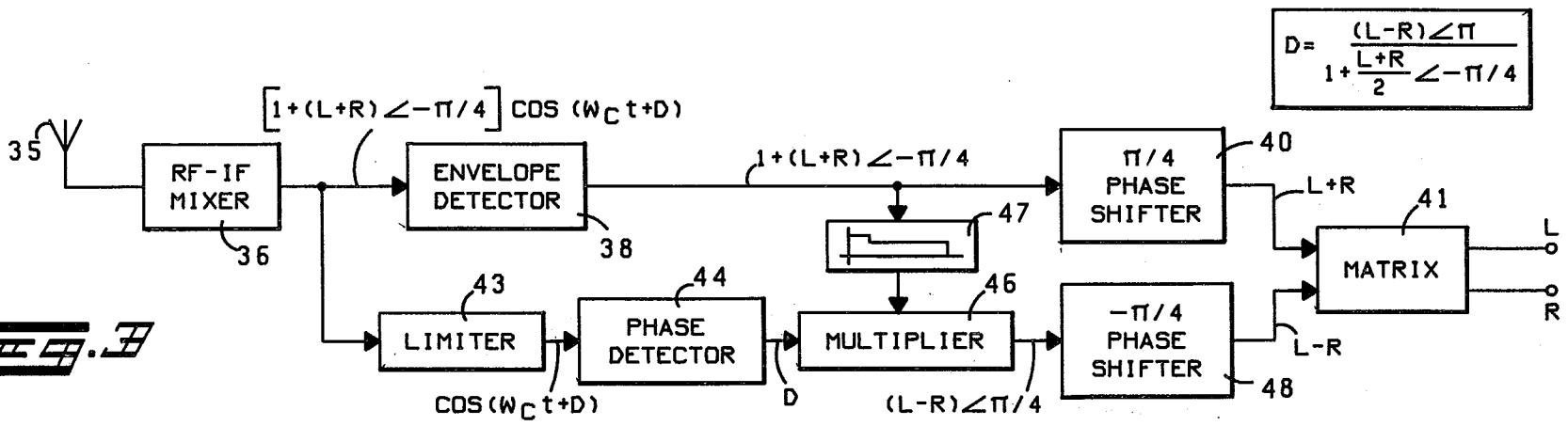
FIG. 3 is a block diagram of a receiver for receiving and demodulating the signal from the transmitter of FIGS. 1 and 2.

FIG. 3 is a block diagram of a receiver for receiving and demodulating the signal from a transmitter such as that of FIGS. 1 and 2. The signal may be received from an over-the-air transmission by antenna 35 and processed in the RF-IF-mixer 36. The output signal from the RF-IF-mixer 36 is $[1+(L+R)\angle\pi/4] \cos(\omega_c t+D)$ where D is proportional to: $[(L-R)\angle\pi/4]/\{1+[(L+R)/2]\angle-\pi/4\}$. This signal is coupled to an envelope detector 38, the output signal of which is then $1+(L+R)\angle-\pi/4$. This signal is coupled to the $\pi/4$ phase shifter 40, and the output signal (L+R) is coupled to the matrix 41. The RF-IF-mixer 36 output signal is also coupled to a limiter 43 which provides an amplitude-limited signal proportional to $\cos(\omega_c t+D)$. The output signal from a phase detector 44 is thus proportional to D as given above and it is coupled to a multiplier 46 as is the output of a filter 47. The filter 47 input is coupled to the output of the envelope detector and may be simply a low pass filter for providing an output proportional to $1+[(L+R)/2]\angle-\pi/4$. When the output signal from the phase detector 44 is multiplied by the output signal from the filter 47 in the multiplier 46, the output of the multiplier 46 is proportional to $(L-R)\angle\pi/4$. When this signal is coupled to the $-\pi/4$ phase shifter 48, the output of the phase shifter is L−R. The L−R signal is coupled to the matrix 41 for providing outputs of L and R for coupling to separate audio amplifier/speaker systems for stereophonic reproduction of the original program source signals.

Figure 4:
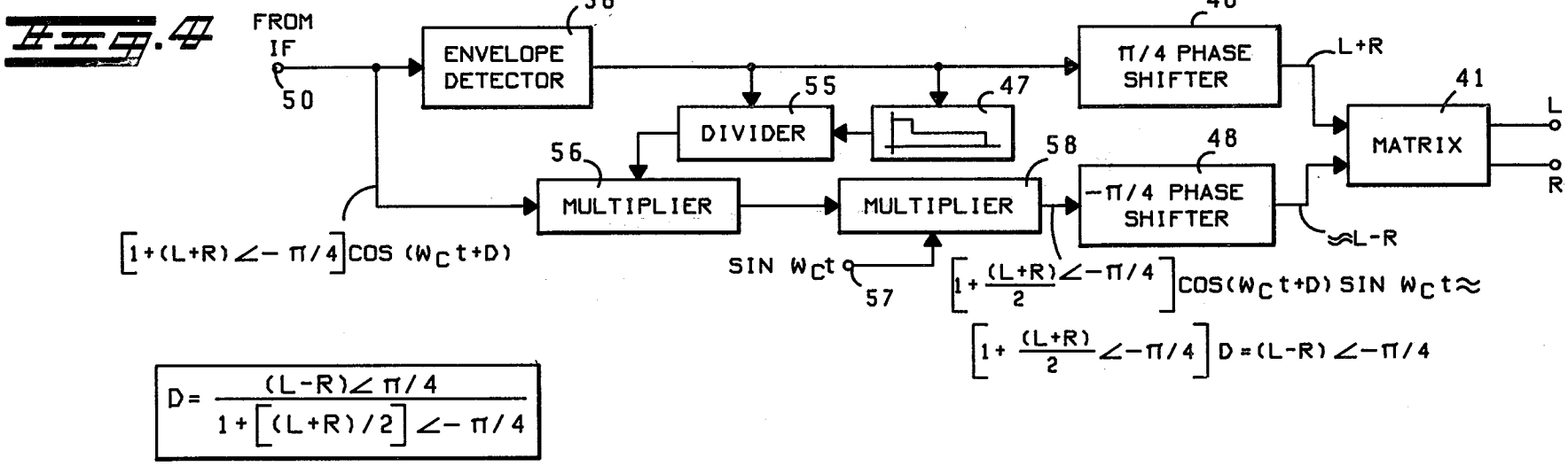
FIG. 4 is a block diagram of another receiver for utilizing the signal from the transmitter of FIGS. 1 and 2.

FIG. 4 is a second embodiment of a receiver for demodulating a signal as provided by the transmitter of FIGS. 1 and 2. The signal at the terminal 50 is the output of an RF-IF-mixer stage and may be represented by $[1+(L+R)\angle-\pi/4] \cos(\omega_c t+D)$ as in FIG. 3. As before, this signal is coupled to the envelope detector 38, the phase shifter 40 and matrix 41. The envelope signal $[1+(L+R)\angle-\pi/4]$ from the output of the envelope detector 38 is coupled to the filter 47 which provides a signal $1+[(L+R)/2\angle-\pi/4$ to a divider 55 where it is divided by the output of the envelope detector 38. The divider output signal is coupled to a multiplier 56 to be multiplied by the signal from the terminal 50. Thus the output of the multiplier 56 is $[1+[(L+R)/2]\angle-\pi/4] \cos(\omega_c t+D)$. This signal being coupled to a multiplier 58 along with a $\sin \omega_c t$ signal, which may be supplied from a source such as a phase locked loop, the output of the multiplier 58 is then $\{1+[(L+R)/2]\angle-\pi/4\} \cos(\omega_c t+\phi) \sin \omega_c t$ which is approximately equal to $\{1+[(L+R)/2]\angle-\pi/4\phi$. As will be noted, this multiplier output signal is a close approximation to $(L-R)\angle-\pi/4$, thus the output of the phase shifter 48 in this embodiment is approximately equal to L−R and the outputs of the matrix 41 are approximately L and R. In this instance a simplified circuit has been achieved by accepting a slight compromise in the ultimate output signals.

FIG. 5 is an embodiment of a receiver similar in most respects to that of FIG. 4, but without the slight distortion therein. The input and output signals of the envelope detector 38, phase shifter 40, filter 47, divider 55 and multiplier 56 are as shown and described with respect to FIG. 4. When the output of the multiplier 56 is coupled to a phase detector 60, the output signal thereof becomes $\{1+[(L+R)/2]\angle-\pi/4\}D=\{1+[(L+R)/2]\angle-\pi/4\}[-(L-R)\angle-\pi/4]/\{1+[(L+R)/2]\angle-\pi/4\}=(L-R)\angle--\pi/4$. Thus, the output of the phase shifter 48 is L−R and the outputs from the matrix 41 are exactly L and R.

FIG. 6 is a transmitter similar to that of FIGS. 1 and 2, but having different inputs. One signal M, at the input terminal 65, is applied to both of the phase shifters 15 and 16. The output signal of the adder 18 is then $1+(M/2)\angle-\pi/4$. The output signal of the divider 21 is then $(M\angle\pi/4)/[1+(M/2)\angle-\pi/4]$ and the signal as transmitted is of the form $(1+M\angle-\pi/4) \cos(\omega_c t+D')$ where D' is $(M\angle\pi/4)/[1+(M/2)\angle-\pi/4]$. This signal can be received by the receivers of FIGS. 3, 4 and 5 and would produce only a single output signal. It would, however, be preferable to utilize any standard single sideband receiver. This transmitter has wide application in the field of communications where conservation of bandwidth is an important consideration.

Thus there has been described, in accordance with the invention, a system for providing a signal to be transmitted, received and demodulated which is a so-called CSSB signal having one program source signal on one set of sidebands and, for stereophonic transmission, another program signal on the other set of side bands, with essentially no distortion. It will be obvious that other modifications and variations of the embodiments disclosed are possible and it is intended to cover all such as fall within the spirit and scope of the appended claims.

What is claimed is:

1. A transmitter for providing a compatible AM stereo signal of the form $[1+(L+R)\angle\phi] \cos(\omega_c t+D)$ where D is $[(L-R)\angle\theta]/\{1+[(L+R)/2]\angle\phi$, where $\phi$ and $\theta$ differ by 90° and L and R are distinct program signals, the transmitter comprising in combination:

first adder means for combining additively the L and R program signals;

second adder means for combining subtractively the L and R program signals;

phase shifter means coupled to shift the phase of at least one of the first and second adder means output signals to provide a 90° phase difference between said output signals;

third adder means for adding a DC component to the phase-shifted output of the first adder means;

divider means coupled to divide the phase-shifted output signal from the second adder means by the output signal of the third adder means;

a source of carrier frequency signals;

phase modulating means for modulating the carrier frequency signal with the divider output signal; and amplitude modulating means for modulating the carrier frequency signal with the phase-shifted output signal from the first adder means.

2. A transmitter in accordance with claim 1 wherein $\phi$ is $-\pi/4$ radians ($-45°$) and $\theta$ is $\pi/4$ radians (45°) and the phase shifter means shifts the phase of the output signal of the first adder means by $-\pi/4$ radians ($-45°$) and shifts the phase of the output signal of the second adder means by $\pi/4$ radians (45°).

3. A receiver for receiving a compatible AM stereo signal of the form $[1+(L+R)\angle\phi]\cos(\omega_c t+D)$ where D is $[(L-R)\angle\theta]/\{1+[(L+R)/2]\angle\phi\}$ where $\phi$ and $\theta$ differ by 90° and L and R are distinct program signals, the receiver comprising in combination:

input means for receiving said signal;

first detector means for providing a signal proportional in amplitude to the amplitude modulation on the received signal;

second detector means for providing a signal proportional in amplitude to the phase modulation on the received signal;

filter means coupled to the first detector means for reducing the amplitude of the audio portion of the output signal thereof to substantially one-half with respect to a band of frequencies lower than audio frequencies and including DC;

multiplier means coupled to multiply the output signals of the filter means and the second detector means;

first phase shifter means for restoring the original phase of the L+R signal;

second phase shifter means for restoring the original phase of the L−R signal; and matrixing means coupled to the outputs of the first and second phase shifter means for providing separate L and R output signals.

4. A receiver in accordance with claim 3 wherein $\phi$ is $-\pi/4$ radians ($-45°$) and $\theta$ is $\pi/4$ radians (45°) and wherein the first phase shifter is a 45° phase shifter and the second phase shifter is a $-45°$ phase shifter.

5. A receiver for receiving a compatible AM stereo signal of the form $[1+(L+R)\angle\phi]\cos(\omega_c t+D)$ where D is $[(L-R)\angle\theta]/\{1+[(L+R)/2]\angle\phi\}$ where $\phi$ and $\theta$ differ by 90° and L and R are distinct program signals, the receiver comprising in combination:

input means for receiving said signal;

first detector means for providing a signal proportional in amplitude to the amplitude modulation on the received signal at the angle $\phi$;

second detector means for providing a signal substantially proportional in amplitude to $(L-R)\angle\theta$;

first phase shifter means for shifting the phase of the output signal from the first detector means by $-\phi$;

second phase shifter means for shifting the phase of the output signal from the second detector means by $-\theta$; and matrixing means coupled to the outputs of the first and second phase shifter means for providing signals substantially proportional to L and R.

6. A receiver in accordance with claim 5 wherein $\phi$ is $-45°$ and $\theta$ is 45°.

7. A transmitter for transmitting a compatible single sideband signal of the form $[1+M\angle\phi]\cos(\omega_c t+D')$ where M is a program signal, where D′ is $(M\angle\theta)/[1+(M/2)\angle\phi]$, and where $\phi$ and $\theta$ have 90° phase difference therebetween, the transmitter comprising in combination:

a program signal source;

first phase shifter means for shifting the phase of the program signal by the angle $\phi$;

second phase shifter means for shifting the phase of the program signal by the angle $\theta$;

adder means for adding a D.C. component to the output signal of the first phase shifter means;

divider means for dividing the output signal of the second phase shifter means by the output signal of the adder means;

a high frequency signal source for providing a carrier signal;

phase modulator means for phase modulating the carrier signal with the output signal of the divider means; and high level modulator means for amplitude modulating the output signal of the phase modulator means by the output signal of the first phase shifter means.

8. A transmitter in accordance with claim 7 wherein $\phi$ is $-\pi/4$ radians ($-45°$) and $\theta$ is $\pi/4$ radians (45°).

* * * * *

REEXAMINATION CERTIFICATE (849th)

United States Patent [19]

Parker

[11] B1 4,184,046

[45] Certificate Issued May 3, 1988

[54] COMPATIBLE SINGLE SIDEBAND SYSTEM FOR AM STEREO

[75] Inventor: Norman W. Parker, Wheaton, Ill.

[73] Assignee: Motorola, Inc., Schaumburg, Ill.

Reexamination Request:
No. 90/001,330, Sep. 15, 1987

Reexamination Certificate for:

| | |
|---|---|
| Patent No.: | **4,184,046** |
| Issued: | **Jan. 15, 1980** |
| Appl. No.: | **894,051** |
| Filed: | **Apr. 6, 1978** |

[51] Int. Cl.[4] ..... H04H 5/00

[52] U.S. Cl. ..... 381/16; 455/109; 455/203

[56] References Cited

U.S. PATENT DOCUMENTS 4,018,994 4/1977 Kahn ..... 381/15

*Primary Examiner*—Douglas W. Olms

[57] ABSTRACT

A CSSB system for AM stereo provides both second and third order sideband correction in the transmitted signal for reduction of distortion at the receivers. Sum and difference signals are derived from two audio program signals (L and R) and shifted in phase 90° with respect to each other. The carriers is then phase modulated with the ratio of these two signals and amplitude modulated with the sum signal.

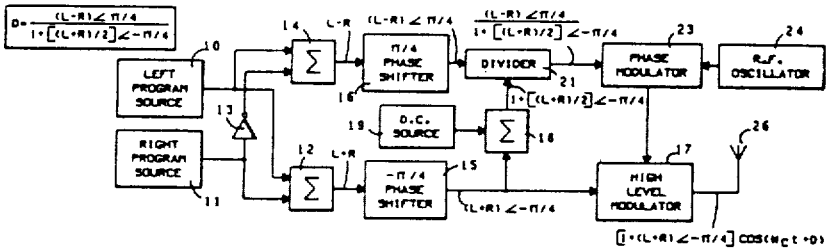

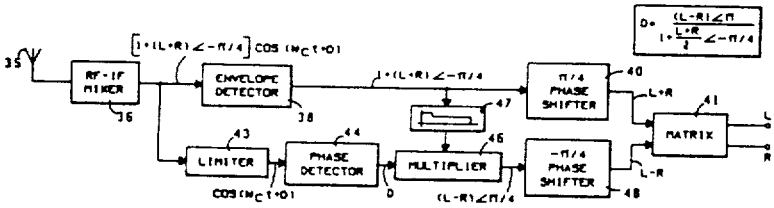

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-8 is confirmed.

* * * * *